US007770295B2

(12) United States Patent
Smith

(10) Patent No.: US 7,770,295 B2
(45) Date of Patent: Aug. 10, 2010

(54) CIGAR CUTTING APPARATUS

(76) Inventor: Andrew Smith, 32 Shore Rd., Pascoag, RI (US) 02859

( * ) Notice: Subject to any disclaimer, the term of this patent is extended or adjusted under 35 U.S.C. 154(b) by 260 days.

(21) Appl. No.: 11/934,812

(22) Filed: Nov. 5, 2007

(65) Prior Publication Data

US 2009/0113718 A1 May 7, 2009

(51) Int. Cl.
*A24F 13/24* (2006.01)

(52) U.S. Cl. ..... 30/113; 30/111; 131/248

(58) Field of Classification Search ..... 30/109, 30/111, 112, 113; 131/248, 250, 252, 253
See application file for complete search history.

(56) References Cited

U.S. PATENT DOCUMENTS

| | | | | | |
|---|---|---|---|---|---|
| 1,061,236 | A * | 5/1913 | Fuller | 30/113 |
| 1,066,365 | A * | 7/1913 | Battin | 30/113 |
| 1,082,257 | A * | 12/1913 | Astruck | 30/113 |
| 1,086,463 | A * | 2/1914 | Robbins | 30/113 |
| 1,119,220 | A * | 12/1914 | Bates | 30/113 |
| 5,791,051 | A * | 8/1998 | Schmidt | 30/113 |
| 5,937,523 | A * | 8/1999 | Van Keppel et al. | 30/112 |
| 5,992,022 | A * | 11/1999 | Carrera Moya | 30/113 |
| 6,164,286 | A * | 12/2000 | Schad | 131/248 |
| 6,708,409 | B2 * | 3/2004 | Yu | 30/113 |
| 7,003,883 | B2 * | 2/2006 | Tapper | 30/90.1 |
| 2007/0089299 | A1 * | 4/2007 | Belaubre | 30/112 |
| 2009/0113718 | A1 * | 5/2009 | Smith | 30/113 |

FOREIGN PATENT DOCUMENTS

| | | |
|---|---|---|
| WO | WO 99/13742 | 3/1999 |

* cited by examiner

*Primary Examiner*—Hwei-Siu C Payer
(74) *Attorney, Agent, or Firm*—Frank Marino

(57) ABSTRACT

A cigar cutter has a body formed of a pair of plates having aligning orifices defining a passage for the head of a cigar to be cut. A pair of opposed cutting blades, movable toward and away from each other within the body each have a cutting edge, which cooperates with the opposing cutting edge during toward movement to cut the cigar head. Each of a pair of bridges is affixed to one of the cutting blades and moveable therewith. A spring engages the bridges and biases them toward an extended position wherein the cutting edges are moved away from each other within the body. A latch automatically engages both of the blades approximate the inward terminus of their toward movement and maintains the blades in a retracted storage position wherein the edges are not exposed. The cutting edges are each inwardly tapered to cause the edges and the cigar to cooperate to force the opposing blades together during their toward movement to automatically sharpen the blades. Each of the bridges has a guide for receiving and guiding the other of the cutting blades during their toward movement.

7 Claims, 4 Drawing Sheets

FIG 3A
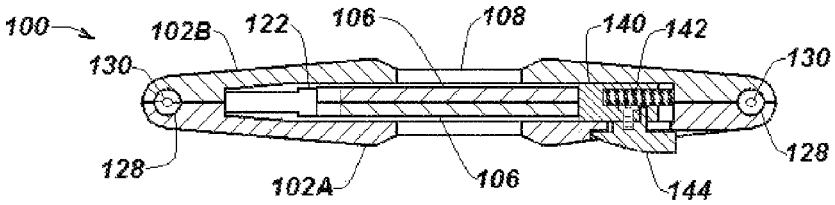
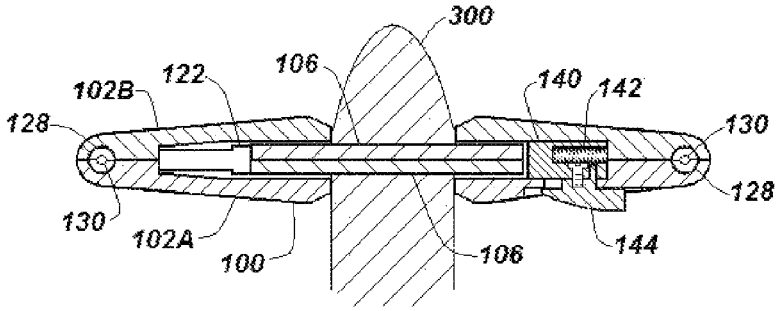
FIG 3B
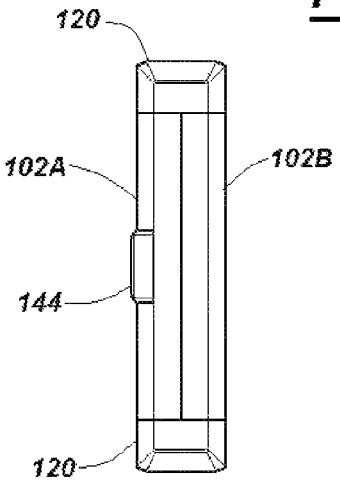
FIG 4A
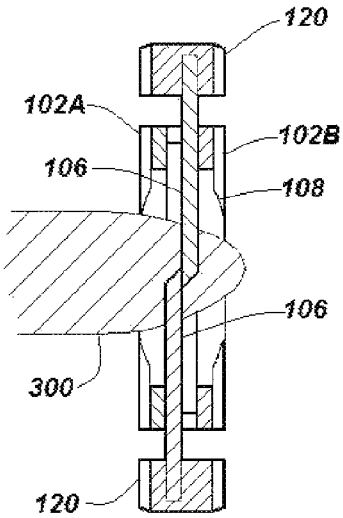
FIG 4B

CIGAR CUTTING APPARATUS

FIELD OF THE INVENTION

The present invention is related to cigar smoking implements and accessories. More particularly, this invention is a device for trimming the head of a cigar in preparation for smoking.

BACKGROUND

Cigars consist of a filler tobacco, rolled within binder tobacco, and then rolled within wrapper tobacco. The filler is often scraps or pieces of flavorful tobacco. Larger leaves of low aesthetic quality and flavor are generally used for binders to tightly contain and compact the filler. Leaves of highest aesthetic quality are typically used for the wrapper, to provide a smooth and consistent outer surface that is attractive to the smoker and comforting to the lips.

Cigars also consist of a barrel, a head, and a foot. The barrel is the long tubular body portion. The foot it the end which is burned during smoking. The head is the tip of the cigar which the consumer places in his mouth during smoking. Cigars are sold with their heads in a "closed" state, that is, the binder and wrapper cover the head completely to retain the compacted filler and provide a neat and tapered tip. Cigars are occasionally also sold with their feet closed for the same reason.

Additionally, binders and wrappers help to keep fresh the filler tobacco, so cigars that are sold with their heads and feet closed tend to remain fresh longer.

Another reason that cigars are sold with their heads closed is that cigar smokers generally prefer to open the heads themselves, according to their smoking preferences and comfort. If the opening size is larger, more flow will result, which will result in more flavor, but will also cause the cigar to burn faster and hotter. A smaller opening will cause the cigar to burn slower and cooler, but will provide a milder flavor.

Implements for opening the heads of cigars come in two main types, cutters and punches. Punches are tubular cutting tools that create a longitudinal hole into the head. The size of the hole is always the same as the size of the punch. Since a punch is unable to cause variously sized openings, the smoker is unable to customize the opening according to his smoking preference.

Cutters, on the other hand, typically consist of one or two sharp blades that traverse and slice through the head to remove the head tip and create an opening of a size according to the slice's distance up the barrel. If the head is sliced further up the barrel, the opening size will be larger. A head that is sliced closer to the tip will have a smaller opening. The smoker is able to customize the size of the opening according to his smoking preference according to the distance up the barrel that he makes the slice.

Cutters which have a large enough opening may also be used to open the feet of cigars that are sold with their feet closed or to trim back previously partially smoked cigars.

A traditional disadvantage of cutters versus punches has been the inability of cutters to create a clean and well-defined cut that does not damage the constitution of the cigar. Especially as their blades become less sharp, cutters tend to crush the cigar and loosen the compacted filler within adjacent to the cut. Such loosened filler will not only alter the flow characteristics of the cigar, but will then tend to fall from the head through the opening as the cigar is being smoked, sending undesirable flakes of filler into the smoker's mouth.

Such problems are typically caused by either a single-bladed cutter whose blade is dull and therefore crushes the head tip as it is forced through the cigar, a dual-bladed cutter whose blades are dull and therefore crush the head tip as they are forced through the cigar, or a dual-bladed cutter whose blades are not properly aligned. For clean and quality slicing by a dual-blade cutter, it is critical the blades must remain sharp, and must cooperate to traverse the head from opposite sides along a precise slicing plane. Blades whose cutting edges are not kept sharp and/or that are not perfectly coplanar will abuse the head and destroy the constitution of the filler within. But dual blade cutters have heretofore failed in their ability to remain sharp or to cooperate along a precise slicing plane.

It is therefore an object of the present invention to provide a dual-bladed cigar cutting device whose blades are automatically self-sharpening during use.

It is another object of the invention to provide a dual-bladed cigar cutting device whose blades cooperate to maintain a precise slicing plane.

It is another object of the invention to provide a dual-bladed cigar cutting device whose blades are biased to move only along the slicing plane.

It is another object of the invention to provide a dual-bladed cigar cutting device whose blades are biased against each other during slicing along the slicing plane.

It is another object of the invention to provide a dual-bladed cigar cutting device which has a compact and safe storage condition in which the blade edges are protected and unexposed.

It is another object of the invention to provide a cigar cutting device which automatically locks into its compact and safe storage condition at the completion of a cut.

Further objects and advantages of the present invention will become apparent in view of the following disclosure of an exemplary embodiment thereof.

SUMMARY OF THE INVENTION

The invention is a dual-blade cigar cutter arranged to overcome the deficiencies of the prior art by providing means to automatically self-sharpen the blades during use, means to cause the blades to cooperate to guide and hold the cigar head in proper position for cutting, means to maintain a precise slicing plane, means to bias the blades to move only along the slicing plane, means to bias the blades against each other during slicing along the slicing plane, and means for automatically locking the blades in a compact and safe storage position at the end of the cutting stroke.

As such, a cutter according to the invention has blades which remain sharp and which cooperate to guide the cigar tip into proper position for cutting and to slice through the cigar head along a precise slicing plane, thereby minimizing trauma to the cigar, providing a clean and well defined opening in the head, and avoiding the inadvertent spillage of filler from the opening during smoking.

The body of the exemplary cutter is formed of two plates having aligned circular orifices defining a passage for positioning the head or foot of a cigar to be cut, with the opposing blades disposed and movable within a cavity between the two plates. The blades include semicircular sharpened cutting edges which have edge contours shaped to cooperatively cut the cigar head as the blades are forced toward each other. The blades are aligned and guided by each other for optimal cutting precision and are biased against each other as they are forced inwardly, defining a precise slicing plane, eliminating any inter-blade gap, and causing each blade edge to sharpen itself against the other during cutting. Each blade is affixed to a bridge for mounting the blade and providing a guide for the opposing blade and a blade activation surface for causing the toward motion of the blade during cutting. A pair of compression springs traverses between and engages the opposing bridges to provide an outward force that biases the blades to an open condition ready for cutting. The springs cooperate to balance and direct the outward bias and evenly share the counterforce against inward gripping by the user to force the blades together for cutting.

The blades are compressed together by a simple gripping motion of the actuation surfaces after the head of the cigar is properly positioned between the open blades to trim the head (or foot) and create an opening in the cigar for smoking. The contouring of the blade edges cooperates with the cigar during cutting to both guide the cigar into proper position for cutting and to force the blades against each other for precise and clean cutting and for self-sharpening.

A latch or pawl within the body engages mating recesses in each blade to retain the blades in a safe and compact "storage" condition and to automatically capture the blades into the storage condition at the completion of the slicing motion. During the storage condition, the blade edges are protected for safety and to avoid damage to the sharp edges. The latch causes the blades to remain in the compact and safe storage condition against the opening bias of the blades. Release of the latch allows the compression springs to push the blades outwardly into the ready condition in preparation for cutting. The smoker may select any slicing position along the cigar accurately and in full view of the cigar.

Further features and aspects of the invention are disclosed with more specificity in the Detailed Description and Drawings of an exemplary embodiment provided herein.

BRIEF DESCRIPTION OF THE DRAWINGS

Many aspects of the invention can be better understood with reference to the following drawings. The components in the drawings are not necessarily to scale, emphasis instead being placed upon clearly illustrating the principles of the present invention. Moreover, in the drawings, like reference numerals designate corresponding parts throughout the several views.

FIG. 3A is a sectional top view of the cigar cutter of FIG. 1A in its storage condition, taken at the vertical centerline of the cutter;

FIG. 3B is a sectional side view of the cigar cutter of FIG. 1A during cutting, taken at the vertical centerline of the cutter;

FIG. 4A is a right side view of the cigar cutter of FIG. 1A in its storage condition;

FIG. 4B is a sectional right side view of the cigar cutter of FIG. 1A during cutting, taken at the vertical centerline of the cutter.

DETAILED DESCRIPTION

Figure 1A:
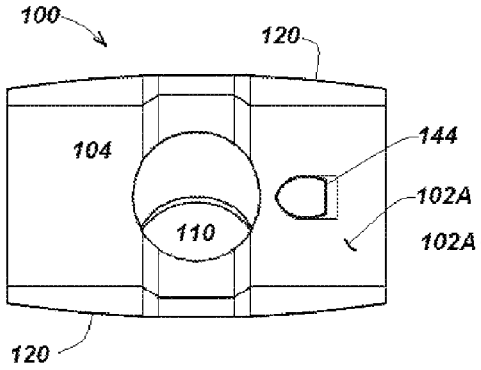
FIG. 1A is a front view of a cigar cutter according to an exemplary embodiment of the invention in its storage condition.
Figure 1B:
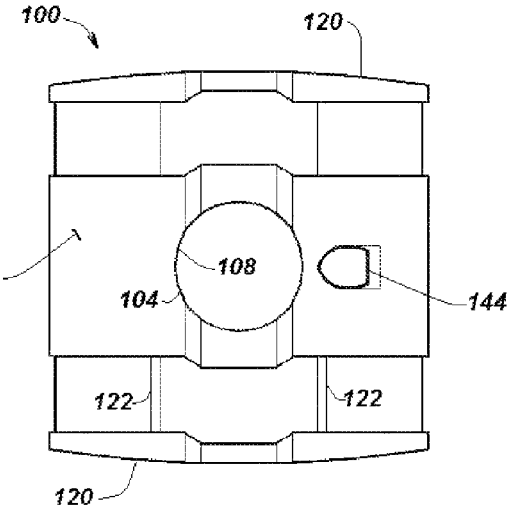
FIG. 1B is a front view of the cigar cutter of FIG. 1A according to an exemplary embodiment of the invention in its ready condition.

Reference is now made to FIGS. 1A through 5, where there is shown an exemplary cigar cutter 100 according to just one of the infinite number of possible cigar cutters within the scope of the invention.

Cutter 100 has a body formed of two plates; front plate 102A and rear plate 102B. The plates are preferably cast of aluminum, but may be made of any equivalent material, such as another metal or a polymer. The plates are preferably fastened together with screws but may be mechanically joined by any equivalent means, such as riveting, post head peening, welding, or using an adhesive.

Front plate 102A is a mirror image of rear plate 102B; excepting that front plate 102A has mounted thereto and passed there-through a blade retaining latch mechanism, which will be described in further detail later in the disclosure. Both plates include a circular orifice portion, which portions are aligned when plates 102A and 102B are assembled together to form cigar head receiving orifice 104, which defines a passage for positioning the head of a cigar to be cut. The orifice is preferable about 13/16" in diameter.

Also when plates 102A and 102B are assembled together, the body forms a cavity for receiving and entrapping a pair of identical and opposingly slidable blade assemblies each including a planar cutting blade 106, a bridge 118 and an activation bar 120.

The planar cutting blades 106 are disposed in side-by-side and overlapping relationship between the two plates. Blades 106 each have a substantially semi-circular opening 108 including cutting edge 110. The two semi-circular openings cooperate when the cutter is opened and ready for cutting to form a preferably 13/16" circular opening aligned with orifice 104 of the plates.

The contouring of cutting edges 110 is preferred not only because it provides an edge that is extremely sharp, but also because it is found to assist openings 108 in positioning and retaining the cigar head in the receiving orifice 104 during cutting better than prior art cutting blades.

Figure 2A:
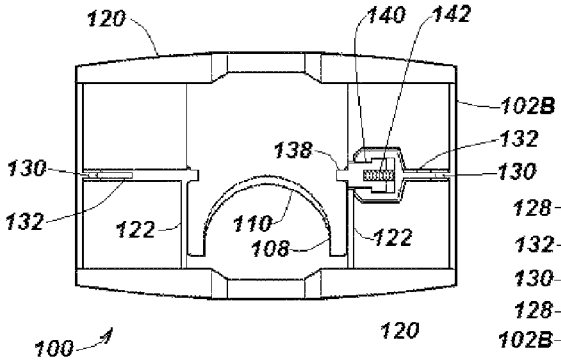
FIG. 2A is a front view of the cigar cutter of FIG. 1A in its storage condition with its latch button and top housing removed.
Figure 2B:
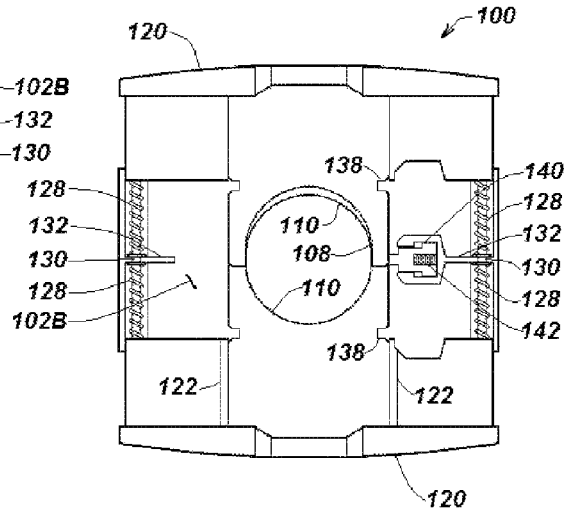
FIG. 2B is a front view of the cigar cutter of FIG. 1A in its ready condition with its top housing removed.
Figure 2C:
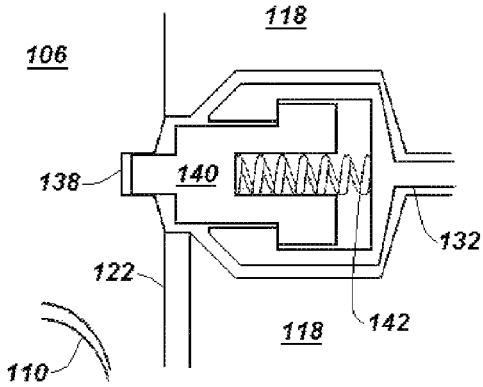
FIG. 2C is a close up front view of the locked latch from FIG. 2A.
Figure 2D:
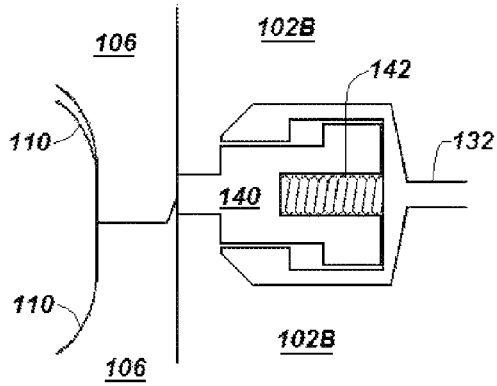
FIG. 2D is a close up front view of the unlocked latch from FIG. 2B.
Figure 2E:
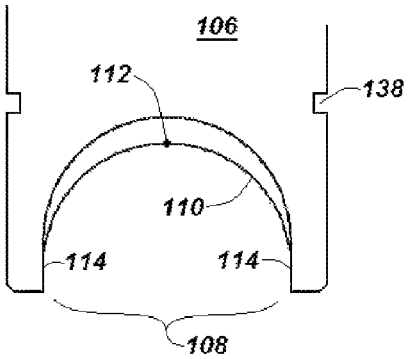
FIG. 2E is a front view of a cutting blade from the cigar cutter of FIG. 1A.
Figure 2G:
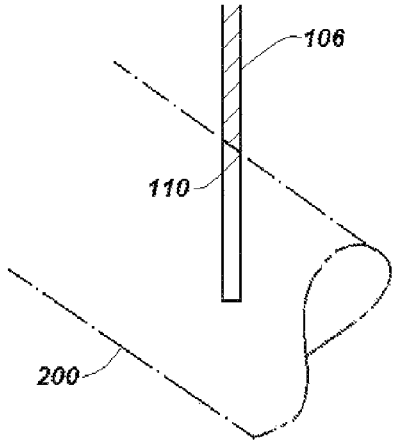
FIG. 2G is a side sectional view through the cutting blade of FIG. 2E.
Figure 2F:
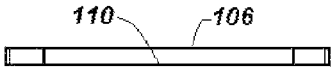
FIG. 2F is a bottom view of the cutting blade of FIG. 2E.
Figure 5:
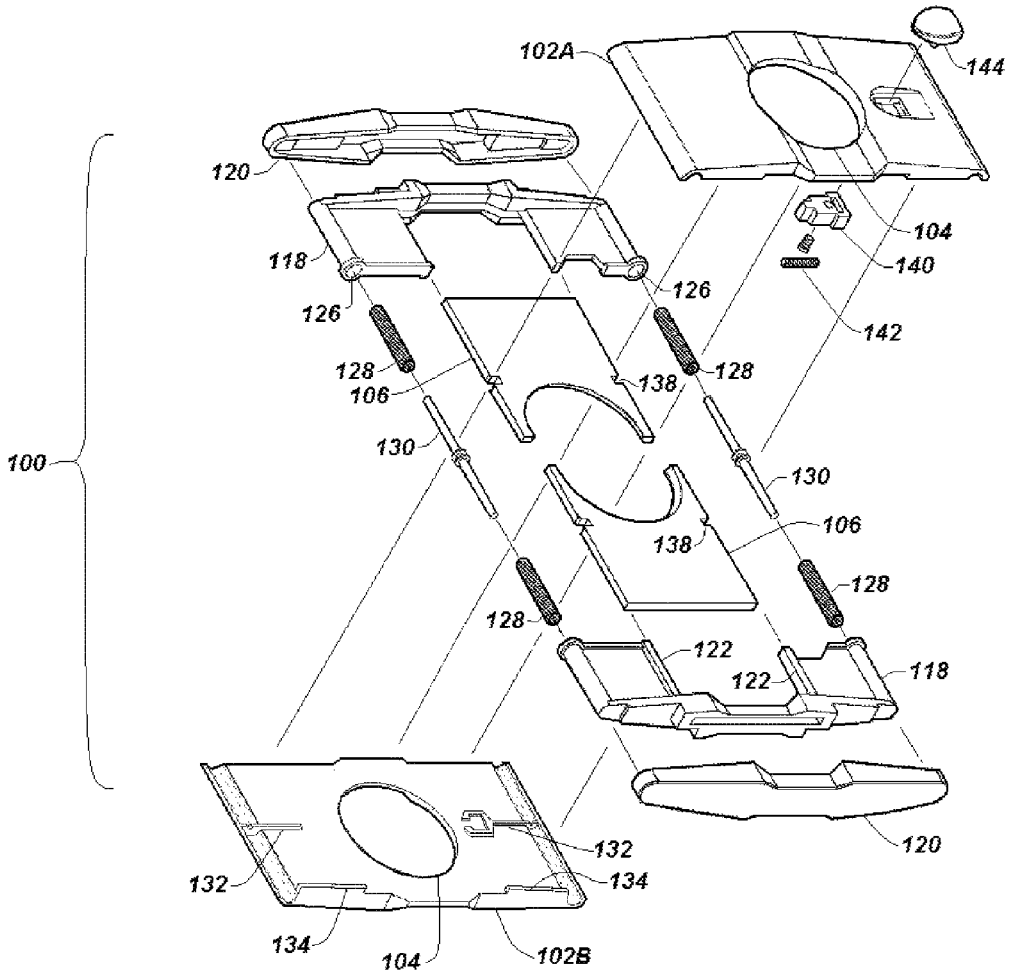
FIG. 5 is an exploded perspective view of the cigar cutter of FIG. 1A.

As seen in FIGS. 2E to 2G, cutting edge 110 is preferably formed by a cylindrical grinding rod 200 disposed during grinding vertically aligned with the axis of opening 108 and horizontally disposed at an angle there-from. Alternatively, the edge may be shaped by a toroidal-shaped grinding wheel. Cutting edge 110 thereby forms a sharp and acute edge at the root 112 of semi-circular opening 108, transitioning to a blunt and non-sharp edge at the sides 114 of the opening. As will be explained later in the disclosure, this contouring allows that opening to guide the cigar head with the blunt sides towards the sharpest root portion of the edge as the blade is closed onto the head for cutting.

The blades are preferably made of hardened and precision ground stainless steel plate and are each affixed to an identical bridge member comprising bridge 118 and activation bar 120. The bridges and activation bars are preferably made of cast aluminum, but could be made of any equivalent material, such as another metal or a polymer. If the bridges were made of a polymer, the polymer would preferably be glass-reinforced. The blades are preferably permanently press-fitted into the bridge, but could be affixed by fasteners or could be cast or molded into the bridge in an insert-forming process. The actuator bars may be integrally formed with the bridges, or may be affixed to the bridges by fasteners, welding, gluing, or any other equivalent means.

Each bridge includes guide ridges 122 for receiving and aligning the opposing blade during cutting, which is found to improve cutting precision by minimizing reliance on the housing cavity to guide the blades and eliminating multi-component tolerance stack-up.

Each bridge has a pair of vertically disposed tubular pockets 126 for receiving a helical compression spring 128, which in turn receives guide pin 130. Each guide pin is long enough to be shared by the opposing blades so that the cutter needs only two guide pins to engage the four compression spring, each pin associated with either the right or left side of both blades. As can be appreciated, compression springs 128 bias bridges 118 and therefore blades 106 apart towards the open and "ready" condition. Guide pins 130 maintain the two associated compression springs 128 in coaxial alignment during opening and cutting to ensure that the biasing force of the compression springs is properly balanced and directed.

Plates 102A and 102B include walls 132 for stopping the inward motion of bridges 118 and walls 134 for stopping the outward motion. Each of blades 106 contains a retaining slot 138, which slots line up adjacent the aforementioned latch mechanism as the blades reach the storage condition at the inner terminus of the cutting motion. The latch mechanism consists of pawl 140, retention spring 142, and latch button 144. The latch button and pawl 140 are affixed together by a screw through a slot in front plate 102A and movable together towards or away from the cutting blades, and are biased towards the inward retaining position by retention spring 142.

An advantageous feature of the cutter of the present embodiment lies in the use of two identical blade assemblies. Both blade assemblies use identical blades 106, bridges 118, and activation bars 120, and each blade assembly is merely repositioned identical of the other in a flipped-over state. This not only reduces component inventory, but reduces the tooling of molds and related manufacturing costs, and ensures perfect balance between the blades and cutting edges.

With the cutter initially in the compact storage condition, slots 138 are aligned and pawl 140 resides within the slots to retain the blades in the closed state. Latch button 144 may be pushed outwardly against the retention spring's bias to pull pawl 140 from slots 138 and allow compression springs 128 to force the blade assemblies apart, thereby creating an open passage through which the cigar head may be placed.

Gripping and squeezing together of activation bars 120 causes blade edges 110 to engage the cigar 300, initially at the blunt sides of the blades for cigars that are not perfectly centered, and to guide the cigar towards the center of the passageway. Once the sharp roots 112 of the edges contact the cigar, cutting commences. The inwardly directed slant of the cutting edge at root 112, is biased by the cigar itself to force each blade more firmly against the opposing blade as the edge passes through the cigar, creating a perfectly precise "zero-tolerance" slicing plane which optimizes the cut, and leave a clean and well define cigar opening, and which causes the blades to rub against each other during cutting to automatically maintain a sharpened root edge.

While the invention has been shown and described with reference to a specific exemplary embodiment, it should be understood by those skilled in the art that various changes in form and detail may be made without departing from the spirit and scope of the invention, and that the invention should therefore only be limited according to the following claims, including all equivalent interpretation to which they are entitled.

I claim:

1. A cigar cutter comprising:

a housing defining a passage for a head of a cigar to be cut;

a pair of opposed cutting blades within said housing, each cutting blade having a cutting edge movable toward the cutting edge of the other cutting blade in a toward motion having an inward terminus wherein said edges are not exposed, and movable away from the cutting edge of the other blade in an away motion, wherein said cutting edges cooperate during said toward motion to cut the cigar;

a biasing element engaging each of said blades and causing said away motion;

a latch for automatically engaging both of said blades approximate the inward terminus of said toward motion;

wherein each of said cutting blades comprises a slot;

said slots of said blades become aligned as said blades approach said inward terminus of said toward motion;

said latch comprises a pawl biased into said aligned slots;

said pawl engages said aligned slots to retain said blades at said inward terminus;

said cutting blades each comprise a bridge having a guide for receiving and guiding the other of said cutting blades during said toward motion; and wherein said biasing element comprises a pair of compression springs each disposed on an opposite side of said passage and each extending between said cutting blades.

2. The cutter of claim 1 wherein each of said compression springs associated with a first of said cutting blades is coaxially aligned with one of said compression springs associated with the other of said cutting blades.

3. A cigar cutter comprising:

a housing defining a passage for a head of a cigar to be cut;

a pair of opposed cutting blades within said housing, each cutting blade having a cutting edge movable toward the cutting edge of the other cutting blade in a toward motion having an inward terminus wherein said edges are not exposed, and movable away from the cutting edge of the other blade in an away motion, wherein said cutting edges cooperate during said toward motion to cut the cigar;

a biasing element engaging each of said blades and causing said away motion;

a latch for automatically engaging both of said blades approximate the inward terminus of said toward motion;

wherein each of said cutting blades comprises a slot;

said slots of said blades become aligned as said blades approach said inward terminus of said toward motion;

said latch comprises a pawl biased into said aligned slots;

said pawl engages said aligned slots to retain said blades at said inward terminus; and wherein each of said opposed cutting blades comprises a bridge cooperating with said blade's associated biasing element to guide said associated cutting blade during said toward motion and to cause said away motion.

4. The cutter of claim 3 wherein said biasing elements are compression springs and each of said bridges comprises a pair of said compression springs straddling said associated blade's cutting edge.

5. The cutter of claim 4 wherein each of said bridges comprises a pair of tubular pockets straddling said associated blade's cutting edge for receiving said bridges associated pair of compression springs, each pocket aligned with said toward and away motions for maintaining said received compression spring in alignment with said toward and away motions.

6. The cutter of claim 5 further comprising a plurality of guide pins, each received within and coaxially aligned with one of said compression springs.

7. The cutter of claim 6 wherein each of said compression springs associated with a first of said cutting blades is coaxially aligned with one of said compression springs associated with the other of said cutting blades.

* * * * *